United States Patent [19]

Peterson

[11] Patent Number: 4,458,430

[45] Date of Patent: Jul. 10, 1984

[54] SHOE SOLE CONSTRUCTION

[76] Inventor: Lars G. B. Peterson, Solnedgången 32, S-433 34 Partille, Sweden

[21] Appl. No.: 363,635

[22] Filed: Mar. 30, 1982

[30] Foreign Application Priority Data

Apr. 2, 1981 [SE] Sweden ..... 8102124

[51] Int. Cl.[3] ..... A43B 13/18; A43B 13/20

[52] U.S. Cl. ..... 36/28; 36/29; 36/35 B; 128/594

[58] Field of Search ..... 36/28, 29, 44, 35 B; 128/594

[56] References Cited

U.S. PATENT DOCUMENTS

| | | | |
|---|---|---|---|
| 2,080,499 | 5/1937 | Nathansohn | 36/29 |
| 3,469,576 | 9/1969 | Smith et al. | 128/594 X |
| 3,795,994 | 3/1974 | Ava | 36/29 |
| 4,100,686 | 7/1978 | Sgarlato et al. | 36/29 |
| 4,129,951 | 12/1978 | Petrosky | 36/29 |
| 4,237,625 | 12/1980 | Cole et al. | 36/28 |
| 4,358,902 | 11/1982 | Cole et al. | 36/28 |

FOREIGN PATENT DOCUMENTS

| | | | |
|---|---|---|---|
| 820869 | 11/1951 | Fed. Rep. of Germany | 36/29 |
| 2800359 | 7/1979 | Fed. Rep. of Germany | 36/28 |
| 720257 | 12/1931 | France | 36/29 |
| 338266 | 11/1930 | United Kingdom | 128/594 |

*Primary Examiner*—James Kee Chi

*Attorney, Agent, or Firm*—Harness, Dickey & Pierce

[57] ABSTRACT

A shoe sole construction designed so as to be biodynamically shock-absorbing.

In the sole are provided two cushions which are filled with a fluid and interconnected by means of a number of channels. One cushion is positioned underneath the heel of the foot and the other cushion is positioned underneath the transverse forward arch of the foot.

When the wearer of the shoe sets down his foot into contact with the ground, the heel strikes the ground first and a shock-absorbing effect is then obtained as the rear cushion is compressed. Upon this compression, fluid flows from the rear cushion to the front cushion, which expands and lifts the front arch of the foot, releaving the weight thereon and supporting the front arch when the forefoot is set down on the ground. When the wearer continues the walking cycle, the forward cushion is compressed, causing the rear cushion to expand and the latter is again ready to provide a shock-absorbing effect upon the next step and heel strike.

4 Claims, 6 Drawing Figures

SHOE SOLE CONSTRUCTION

BACKGROUND OF THE INVENTION

The subject invention concerns a shoe sole having a biodynamically shock-absorbing structure. The shoe sole is particularly suitable for sports shoes and may be used for instance for jogging and running on hard surfaces, such as asphalt. It may also be used in walking boots and similar footgear.

In walking and running the foot has to bear considerable weight when it is set down into contact with the ground or the surface underneath. The cushion of fat found for instance in the heel dampens the impact upon heel strikes, that is the phase of the walking cycle when the heel is set down into contact with the surface underfoot. At the midstance stage of the walking cycle, when the whole foot is in contact with the surface, and at the heel elevation stage, the weight is on the lengthwise arch of the foot and on the forward transverse arch of the foot, which may cause deformation of these arches.

Congenital anatomic conditions or weaknesses may impair or weaken these functions and may cause insufficiency problems, which originate from the arches of the foot. The problems caused by weakened arches may be remedied by arch supports which are positioned inside the shoe. Also originally normal arches may, when exposed repeatedly to heavy weights on account of walking and running on very hard surfaces, lose their vaulted shape and consequently their weight-distributing capacity, which could also produce insufficiency symptoms.

This type of problems are common and are primarily caused by the use of bad shoes or e.g. by activities on hard surfaces, such as asphalt and concrete. Preventive as well as therapeutic measures to avoid such insufficiency conditions therefore are very important. Malfunctioning of the feet and absorbing shoes that are badly constructed may also cause damage and lead to insufficiency conditions, particularly in the lower extremities, such as the ankle joint, the menisci, knees, hips and the back.

Sport activities also expose the body to considerable stress and strain. In sports such as running, various kinds of jumping and the like it is particularly during the heel strike stage that considerable weight has to be borne by large portions of the skeleton, which may cause damage to the knee, back or other exposed parts of the body. These damages may occur as a result of long-standing and repeated weight bearing, as is the case with for instance long-distance runners, or may be caused by isolated instances of heavy but unsuitable exposures to weight bearing, such as may be experienced e.g. in triple jumping. Shoes for sports used therefore should have a sole which is able to cushion as far as possible the shocks that arise from the setting down of the foot on the ground. However, the sole must not be too thick, as this would make the shoe too heavy and thus impair the achievable results of the contestant.

Different kinds of sole constructions are available, designed to provide a shoe that obviates the drawbacks outlined in the afore-going. For instance, on the market there are shoes having soles comprising several layers of different materials to provide the desired resiliency. Soles are available that incorporate an air-cushion positioned underneath the heel to provide maximum shock-absorbing properties. Shoes equipped with soles of this kind have a good overall shock-absorbing capacity.

SUMMARY OF THE INVENTION

The purpose of the subject invention is to provide a shoe sole construction capable of providing satisfactory shock absorption while at the same time supporting the forward arch of the foot. The sole in accordance with the invention is suitable for treatment of damages and other insufficiency conditions of the feet, lower parts of the leg, knee and back in addition to which it may be used for the purpose of preventing damages.

The shoe sole construction in accordance with the invention is characterised by the provision in the sole of at least two cushions which are partly or completely filled with a fluid, said cushions adapted to cooperate and positioned in the sole essentially beneath the heel region and beneath the region of the front transverse arch of the foot, said cushions arranged to cooperate so as to ensure that compression of the rear cushion causes expansion of the front cushion and vice versa and that upon expansion of the front cushion the shoe sole is caused to form a supporting bulge beneath the front arch of the foot.

The shoe sole construction in accordance with the invention creates an excellent cushioning effect when the heel is set down into contact with the support underfoot while at the same time the wearer of the shoe receives a dynamic support to the front pad of the foot when the forefoot strikes the ground. Use of a shoe sole construction in accordance with the invention considerably reduces the risks of damages and insufficiency conditions in particularly the arches of the foot and the extremities while at the same time sports activities such as running, jogging, jumping and the like are facilitated.

BRIEF DESCRIPTION OF THE DRAWINGS

The invention will be described in closer detail in the following with reference to the accompanying drawings, wherein.

DETAILED DESCRIPTION OF A PREFERRED EMBODIMENT

Figure 1:
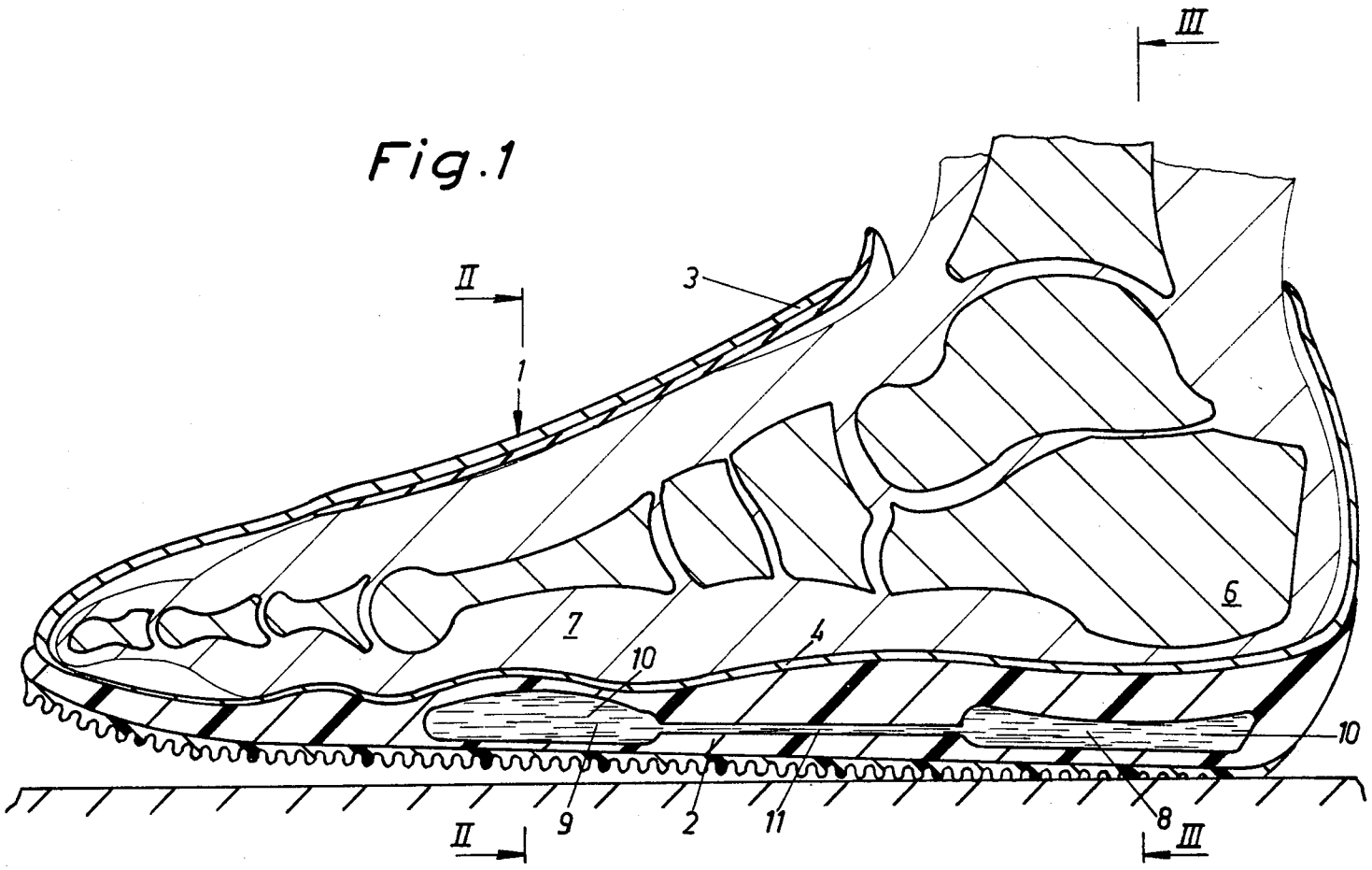
FIG. 1 is a cross-sectional view of a shoe incorporating a sole constructed in accordance with the teachings of the invention, the view showing the stage of the walking cycle when the heel strikes the support.
Figure 2:
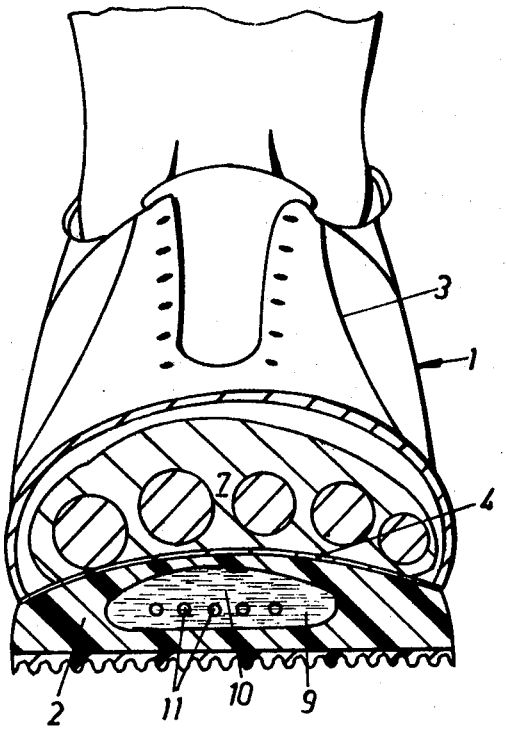
FIG. 2 is a cross-sectional view along line II—II of FIG. 1.
Figure 3:
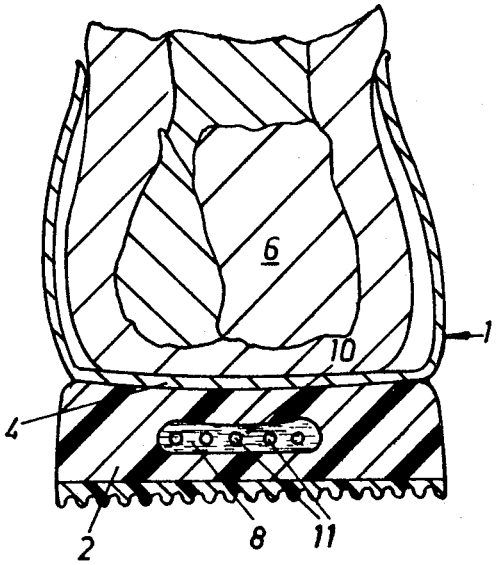
FIG. 3 is a cross-sectional view along line III—III of FIG. 1, FIGS. 4, 5 and 6 are views corresponding to those in FIGS. 1, 2, and 3 but show the stage of the walking cycle when the forward part of the foot strikes the ground i.e. the heel elevation stage, the sectional views being taken along lines V—V and VI—VI in FIG. 4.
Figure 4:
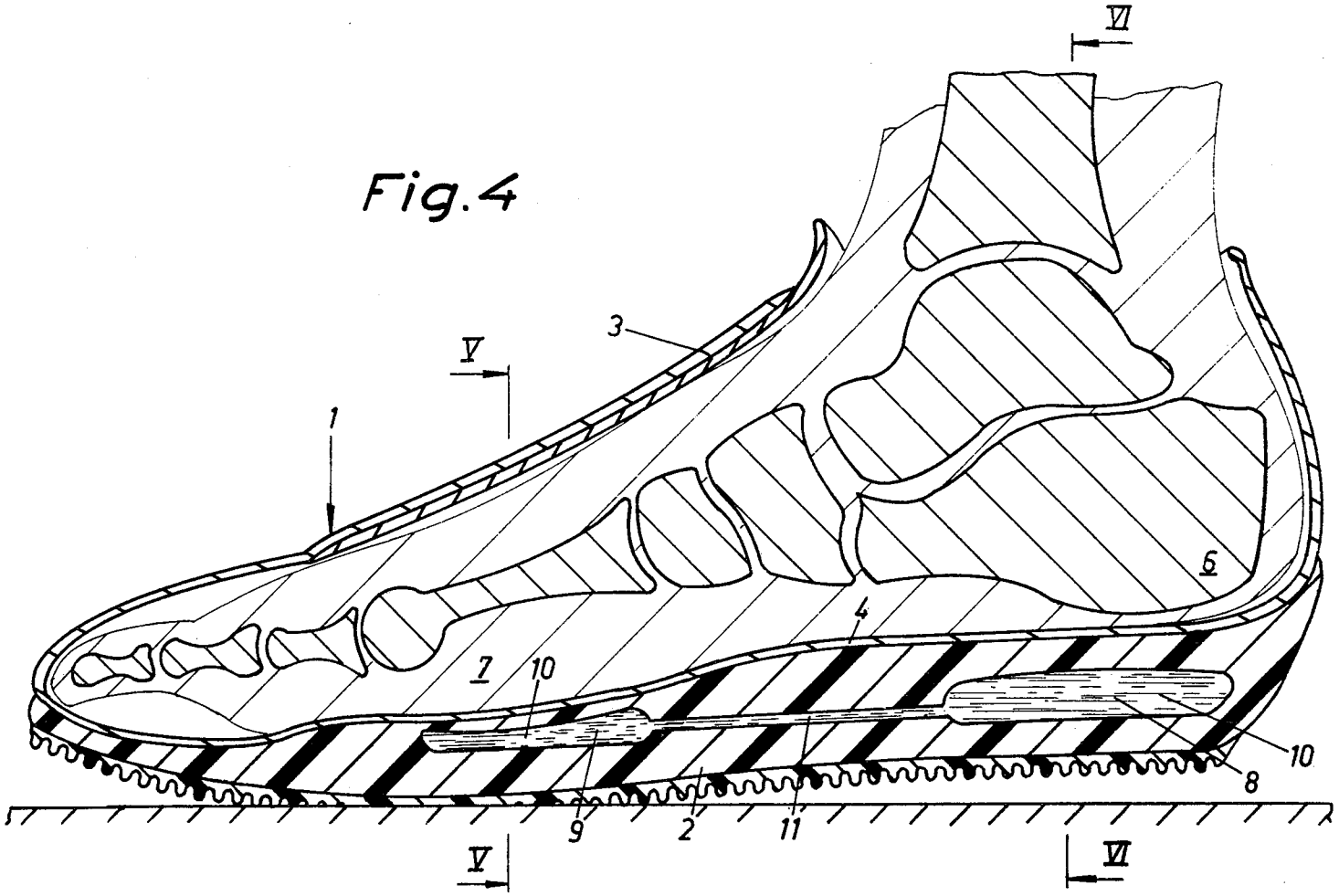
Figure 5:
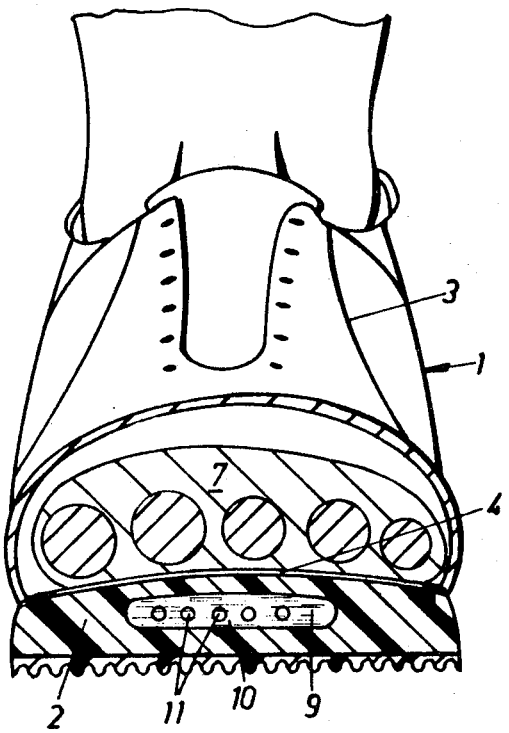
Figure 6:
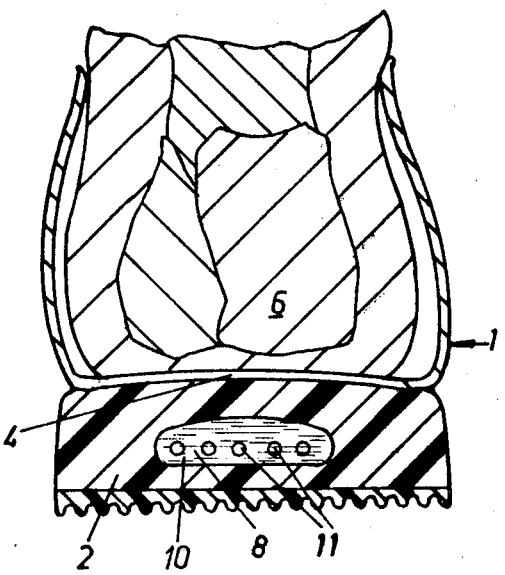

As illustrated in the drawings, the shoe 1 to be used for sports activities comprises a sole 2, uppers 3 and an insole 4. The shoe is shown worn on a foot 5. Underneath the heel 6 of the foot as well as underneath the forward transverse arch or forward pad 7 of the foot the sole is provided with cushions 8 and 9.

The cushions 8 and 9 are filled with a suitable fluid 10. The cushions 8, 9 are adapted to be compressed and expanded. A number of channels 11 interconnect the two cushions. Consequently, fluid is allowed to flow from one cushion to the other through the interconnecting channels 11. When one of the cushions is compressed, the other one expands, as fluid is forced from the compressed cushion to the expanding one. The number and size of the channels may be varied as may also the provision and design of e.g. valves in order to modify the characteristics of the shoe in order to make the sole 2 more or less resilient and increase or decrease its cushioning effect. These and similar characteristics of the shoe sole may also be modified through the choice of the fluid in the cushions and interconnecting channels by selecting fluids of varying viscosity. The more viscous the fluid and/or the less numerous the channels, the more rigid the sole.

The walls of the interconnecting channels 11 (in some cases one single channel 11 suffices) are designed to prevent all expansion or to allow extension to a negligible degree only. As illustrated in the drawing figures this is preferable obtained by forming the interconnecting channels with a considerably smaller cross-sectional area than the cushions 8, 9. This makes the channel walls stronger and thus they do not extend to any significant extent. However, the channels 11 may be formed with a larger cross-sectional area than that shown by way of example in the drawings, in which case the channel walls should be reinforced to achieve the desired effect.

The shoe functions in the following manner. When the wearer puts down his heel on the ground, fluid is forced forwards from the rear cushion 8 through the interconnecting channels 11 to the forwards cushion 9 which expands. The cushion has a certain resistance against expansion which in combination with the fact that the cross-sectional area of the channels is smaller than that of the cushions creates a resistance against displacement of the fluid. In this manner the impact when the heel strikes the ground is cushioned. During the continued walking cycle the following happens. The forward cushion is filled with fluid and consequently lifts, supports and releaves the weight off the front arch of the foot when the body weight is transferred from the heel to the forefoot. When the front arch of the foot is depressed, fluid is forced from the forwards cushion 9 to the rear cushion 8 which expands. The latter is now again ready to exert its cushioning effect when the heel strikes the ground during the following walking cycle.

When expanding or bulging the forwards cushion 9 assumes a somewhat vaulted shape which gives a biodynamically correct support to the transverse arch 7 of the foot.

The size of the cushions 8, 9 is such as to ensure that their surrounding walls are sufficiently strong to take the shearing stress that occur when a lateral weight is applied on the shoe. Weights of this nature occur when the wearer is running through curves and the like.

The amount of fluid in the two cushions and the interconnecting channels is constant at all times, and consequently the resiliency of the shoe, that is, bulgings when a weight is applied on the cushions, may be controlled and modified by selecting a cushion size that is adequate for each individual purpose. Also in this manner it is possible to adjust the shoe properties to suit and agree with the intended purposes and actual needs.

The sole 2 may also be made in the form of a separate insert to be placed inside the shoe for which it is intended.

The sole construction in accordance with the invention is likewise suitable for other shoes than running shoes or walking boots. As one example may be mentioned ski boots designed for down-hill skiing for which purposes boots incorporating the sole in accordance with the invention are highly suitable because this sports activity exposes the body to heavy vibrations and impacts on account of the uneven surface of the slopes and pistes.

It should be understood that the invention is not limited to shoes designed for sports and similar physical activities but is applicable to all kinds of shoes, such as walking boots and shoes, both for damage-preventive purposes and to heal damages that have already been incurred. However, the sole is particularly efficient in applications whenever frequent impacts, vibrations and shocks may be expected.

The embodiment described in the aforegoing and illustrated in the drawings is to be regarded as one example only and a number of modifications are possible within the scope of the appended claims. As mentioned above, the sole may be constructively incorporated into the shoe or form a separate insert sole. In addition, the interaction of the two cushions may be with the aid of a piston arranged to perform a reciprocating motion between the cushions to achieve the same effect as does the fluid flow through the interconnecting channels 11. It is likewise possible to provide valves controlling feed flow and return flow to and from the cushions.

What I claim is:

1. An improved shoe sole construction, the improvement comprising at least two cushions provided in said sole, said cushions being partly or completely filled with a fluid, said cushions adapted to cooperate and positioned in said shoe sole construction substantially solely beneath the heel region and substantially solely beneath the region of the front transverse arch of the foot, respectively, and conduit means extending between said cushions, the walls of said conduit means being substantially more rigid than that of said cushions for insuring that compression of one of said cushions causes expansion of the other, and that upon expansion of one of said cushions said shoe sole construction is caused to form a supporting bulge beneath said front arch of the foot, the forwardmost cushion being configured in transverse cross-section so as to conform to the natural transverse arch of the adjacent portion of the foot.

2. An improved shoe sole construction as claimed in claim 1, wherein the conduit means comprises a number of channels interconnecting said cushions.

3. An improved shoe sole construction as claimed in claim 2, wherein the total cross-sectional area of said number of channels is less the cross-sectional area of said cushions for achieving the desired rigidity of the conduit means.

4. An improved shoe sole construction as set forth in claim 1 wherein the forwardmost cushion is positioned beneath and behind the metatarsal joint.

* * * * *